US007748122B2

(12) United States Patent
Duey

(10) Patent No.: US 7,748,122 B2
(45) Date of Patent: Jul. 6, 2010

(54) KNIFE BLADE OPENING MECHANISM

(75) Inventor: Wes Duey, Oregon City, OR (US)

(73) Assignee: Mentor Group, L.L.C., Oregon City, OR (US)

( * ) Notice: Subject to any disclaimer, the term of this patent is extended or adjusted under 35 U.S.C. 154(b) by 477 days.

(21) Appl. No.: 11/899,206

(22) Filed: Sep. 5, 2007

(65) Prior Publication Data

US 2009/0056146 A1 Mar. 5, 2009

(51) Int. Cl.
*B26B 3/06* (2006.01)

(52) U.S. Cl. ..... 30/159; 30/160

(58) Field of Classification Search ..... 30/153, 30/155, 158–161
See application file for complete search history.

(56) References Cited

U.S. PATENT DOCUMENTS 2,741,841 A * 4/1956 Egeth ..... 30/135
3,834,022 A * 9/1974 Students ..... 30/261
5,044,079 A 9/1991 Gibbs
5,819,414 A 10/1998 Marifone
6,308,420 B1 10/2001 Moser
6,363,615 B1 * 4/2002 Moser ..... 30/161
6,574,869 B1 6/2003 McHenry et al.
6,651,344 B2 * 11/2003 Cheng ..... 30/159
6,675,484 B2 1/2004 McHenry et al.
6,732,436 B2 5/2004 Moizis
7,086,157 B2 8/2006 Vallotton
7,107,686 B2 * 9/2006 Linn et al. ..... 30/159
7,243,430 B1 7/2007 Lerch
7,278,213 B2 * 10/2007 Pardue et al. ..... 30/160
7,293,360 B2 11/2007 Steigerwalt et al.
7,313,866 B2 * 1/2008 Linn et al. ..... 30/159
7,325,312 B1 * 2/2008 Janich ..... 30/161
7,380,340 B1 * 6/2008 Lerch ..... 30/159
7,437,822 B2 * 10/2008 Flagg et al. ..... 30/161
7,627,951 B2 * 12/2009 Glesser ..... 30/161
7,676,931 B2 * 3/2010 Knight et al. ..... 30/158
RE41,259 E * 4/2010 McHenry et al. ..... 30/161
7,698,821 B2 * 4/2010 Ralph ..... 30/160
2002/0124415 A1 * 9/2002 Mizutani et al. ..... 30/261
2003/0140500 A1 * 7/2003 Cheng ..... 30/159
2004/0154170 A1 * 8/2004 Kain et al. ..... 30/161
2004/0158991 A1 8/2004 Freeman (Continued)

OTHER PUBLICATIONS

International Search Report and Written Opinion of the International Searching Authority for PCT/US08/09480 (which is a PCT application claiming priority from the subject U.S. Appl. No. 11/899,206).

*Primary Examiner*—Jason Daniel Prone
(74) *Attorney, Agent, or Firm*—Hancock Hughey LLP

(57) ABSTRACT

A folding knife incorporates an opening assist mechanism that functions to drive the blade from the closed to the open position. A pair of torsion springs held axially on the blade axis pin and within a pair of bushings are stationary relative to the knife handle. One leg of each spring is fixed to a bushing. The opposite leg of the spring rides in a pocket formed in the surface on the blade axially around the opening through which the blade axis pin is inserted. As the blade rotates from the closed position toward the open position, the legs of the springs rotate through and cooperate with structures formed on the bushings to transfer the spring pressure instantly to the blade to drive the blade open.

18 Claims, 7 Drawing Sheets

U.S. PATENT DOCUMENTS

| | | | | |
|---|---|---|---|---|
| 2004/0261272 | A1 | 12/2004 | Moser | |
| 2006/0059694 | A1 | 3/2006 | Carter, III | |
| 2006/0064877 | A1 | 3/2006 | Vallotton et al. | |
| 2007/0137047 | A1* | 6/2007 | Kim | 30/161 |
| 2007/0169354 | A1* | 7/2007 | Ralph | 30/160 |
| 2007/0180702 | A1* | 8/2007 | Hawk et al. | 30/161 |
| 2008/0201953 | A1* | 8/2008 | Bremer et al. | 30/160 |
| 2009/0119926 | A1* | 5/2009 | Nenadic | 30/161 |
| 2009/0265939 | A1* | 10/2009 | Chu | 30/159 |
| 2009/0277015 | A1* | 11/2009 | Duey | 30/160 |
| 2009/0288301 | A1* | 11/2009 | Hawk et al. | 30/161 |

* cited by examiner 14
23
21
50
102
50
17
19
64
64
62
62
47
47
70
70
94
80
80
96
98
45
44
90
90
68
68
92
100
100
18
50
26
50
16

KNIFE BLADE OPENING MECHANISM

FIELD OF THE INVENTION

This invention relates to folding knives equipped with mechanisms that provide an opening assist for the blade, and more particularly to a knife in which springs act on the blade to drive the blade from the closed position to the open position.

BACKGROUND

Most folding knives incorporate some kind of a mechanism that holds the blade or working implement in the closed position in which the sharp edge of the blade is held safely within the handle. There are many known mechanisms for retaining blades in the closed position, and there are obvious reasons why such mechanisms are used. Among other reasons, blade-retaining mechanisms prevent unintended opening of the knife and thus promote safety.

Automatic opening mechanisms and so-called "opening assist" mechanisms may be incorporated into folding knives. Generally speaking, in a knife that has an automatic opening mechanism the blade is held in the closed position by a latched trigger mechanism. When closed, the blade is under a constant "pre-load" pressure from a spring mechanism. When the trigger is released, the blade is automatically driven by the spring mechanism into the open position. On the other hand, with knives that incorporate opening assist mechanisms the blade is retained in the closed position without the need for a latch or trigger. The opening assist function is provided by a spring mechanism that operates on the blade. As the user manually rotates the blade from closed toward the open position, the spring mechanism that acts on the blade reaches a threshold point. After the blade rotates beyond the threshold point the spring drives the blade to the open position.

Both knives equipped with automatic and opening assist mechanisms typically include some kind of locking mechanism to lock the blade open, and with many opening assist knives the same spring mechanism that drives the blade open also retains the blade closed.

For a variety of reasons, opening assist mechanisms are becoming very popular. For example, in appropriate circumstances and for appropriate users, there are many advantages to be derived from assisted opening knives and many situations where automatic knives can be useful. These often include situations where the user has only one hand free. However, even in a knife that includes an automated opening or opening assist mechanism, safety considerations always mandate that the blade stays in the closed position until the user volitionally and intentionally moves the blade into the open position. For example, a mechanism that holds a knife blade closed should never release when the knife is dropped. With the recent increases in popularity of opening assist knives there are many new types of mechanisms being developed.

There is always a need however for mechanisms that provide an opening assist feature for knives.

The present invention comprises folding knife having an opening assist mechanism. In a first illustrated embodiment, the mechanism of the present invention relies upon a pair of torsion springs held axially on the blade axis pin and within a pair of bushings that are stationary relative to the knife handle. There is one spring and one bushing on each lateral side of the blade. One leg of each spring is fixed to the bushing. The opposite leg of the spring rides in a pocket formed in the surface of the blade axially around the opening through which the blade axis pin is inserted. When the blade is in the closed position the torsion springs are "loaded" but do not apply their spring force to the blade, instead applying their force against the stationary bushing. As the blade rotates from the closed position toward the open position, the legs of the springs rotate through and cooperate with structures formed on the bushings to transfer the spring pressure instantly from the bushing to the blade to drive the blade open. As the blade is thus rotated from the closed position toward the open position, once a predetermined rotational point, or "threshold" point in the rotational movement of the blade is passed, the mechanism of the present invention rotationally drives the blade into the fully open position. This is accomplished with the paired springs, which act on the blade and thereby impart sufficient rotational kinetic energy to the blade that the inertia drives the blade into the fully open position. A locking mechanism locks the blade in the open position. As the blade is rotated from the open position to the closed position the torsion springs are once again loaded, and once a desired rotational point is passed one leg of each of the spring moves into a pocket in the bushing and the spring's rotational force is transferred from the blade to the stationary bushing, allowing the blade to remain in the closed position.

The mechanism of the present invention may also be built to rely upon only one torsion spring, which is structurally and functionally identical to the paired springs described above.

BRIEF DESCRIPTION OF THE DRAWINGS

The invention will be better understood and its numerous objects and advantages will be apparent by reference to the following detailed description of the invention when taken in conjunction with the following drawings.

The series of FIGS. 10 through 13 illustrate semi-schematically a sequence of structural steps that occur as the blade rotates from the open to the closed positions.

Figure 10:
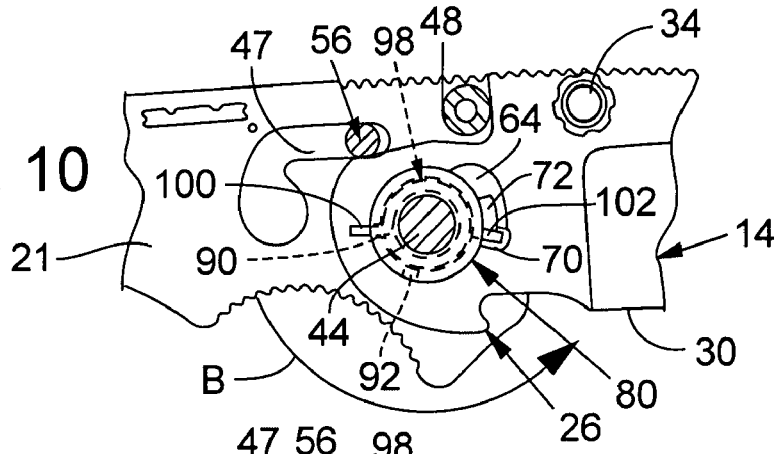

FIG. 10 is a side elevational, semi-schematic and cross sectional view illustrating the structures of the auto assist mechanism when the blade is in the fully open and locked position.

Figure 11:
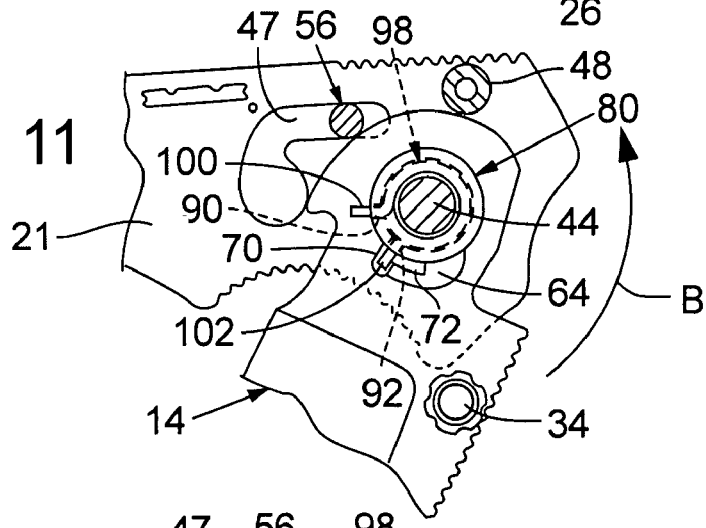

FIG. 11 is a side elevational, semi-schematic and cross sectional view illustrating the structures of the auto assist mechanism when the blade has rotated about 60° from the fully closed position toward the open position.

Figure 12:
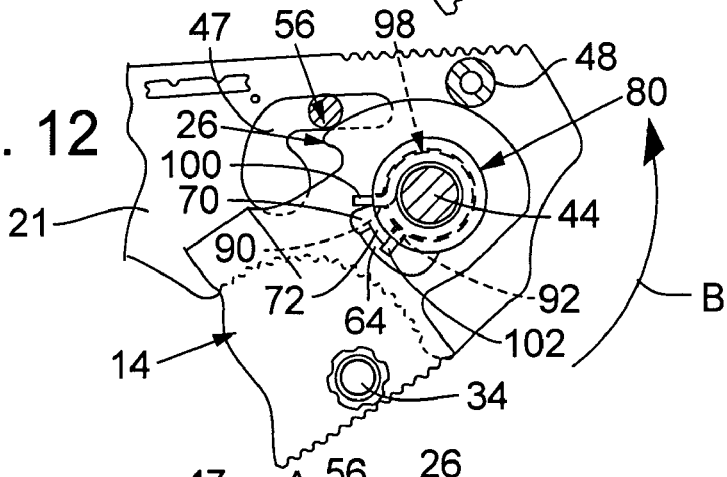

FIG. 12 is a side elevational, semi-schematic and cross sectional view illustrating the structures of the auto assist mechanism when the blade has rotated about 40° from the fully closed position toward the open position.

Figure 13:
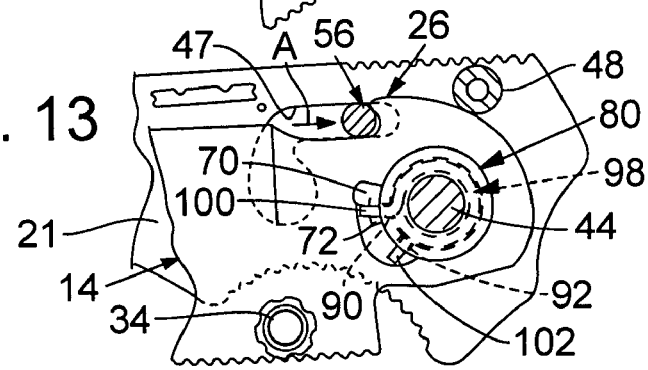

FIG. 13 is a side elevational, semi-schematic and cross sectional view illustrating the structures of the auto assist mechanism when the blade is in the closed position.

Figure 1:
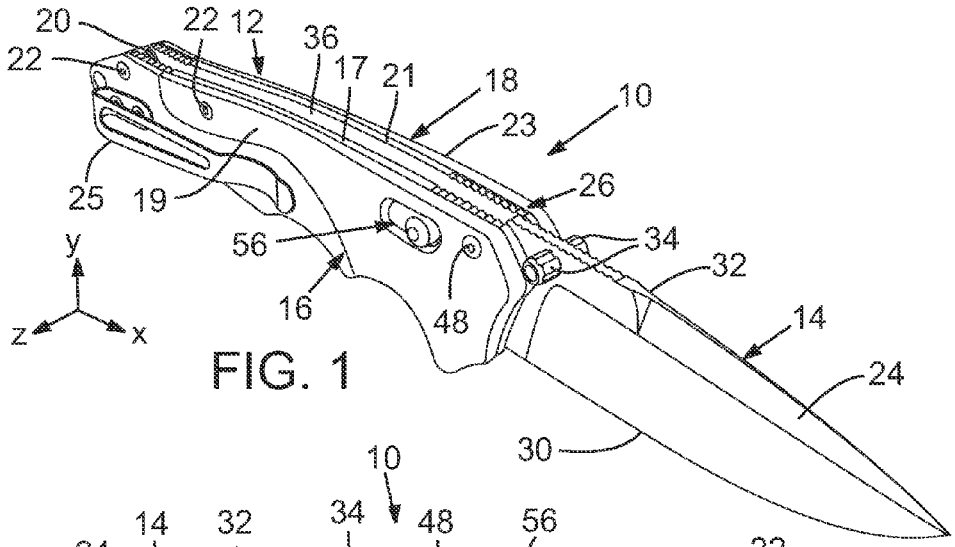
FIG. 1 is perspective view of a first illustrated embodiment of a knife incorporating an opening assist mechanism according to the present invention. The blade of the knife shown in FIG. 1 is in the locked open position.
Figure 14:
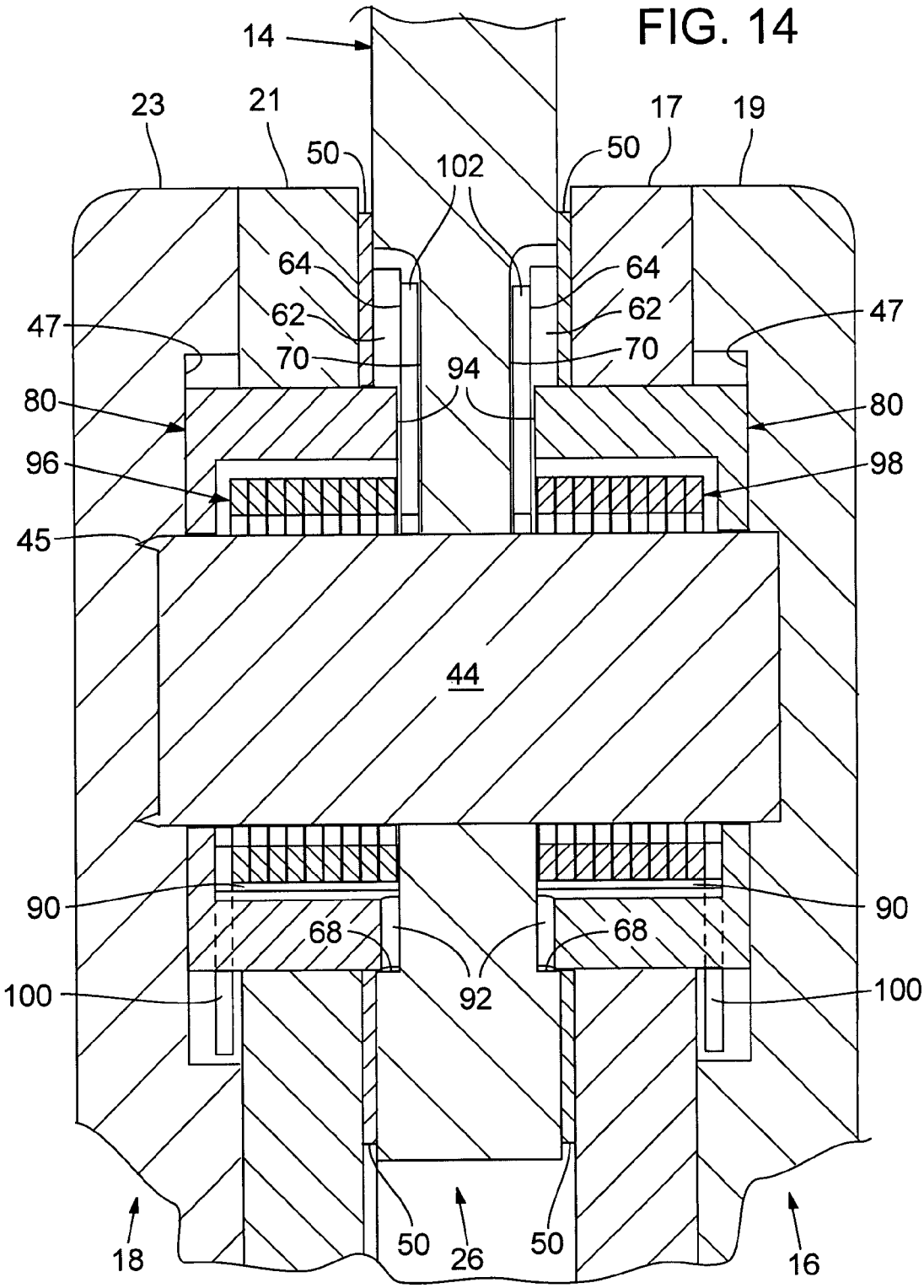

FIG. 14 is a stylized top cross sectional view of the knife of FIG. 1, taken through the forward portion of the handle and through the blade axis, illustrating the blade in the open position.

Figure 15:
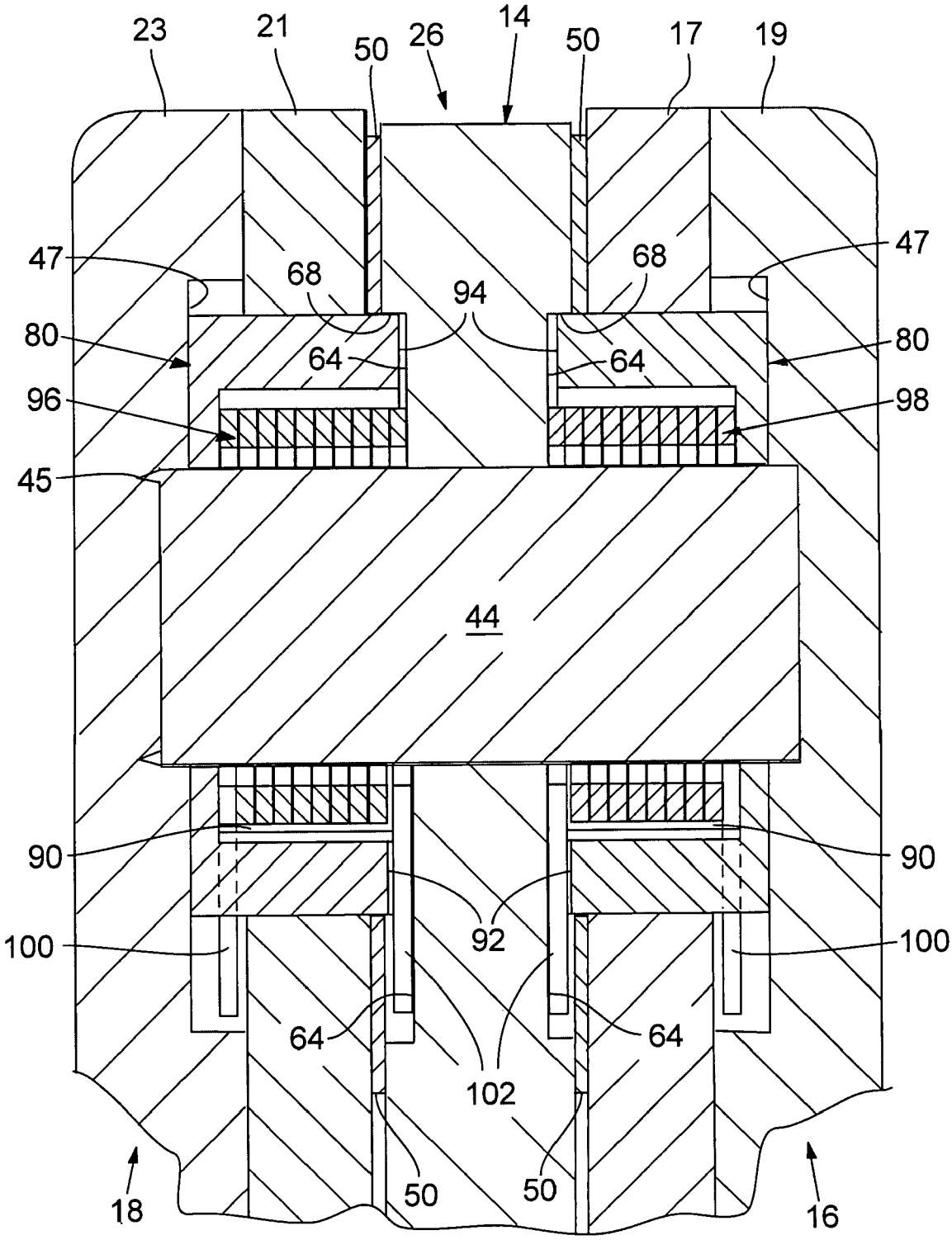

FIG. 15 is a stylized top cross sectional view taken through the same position as FIG. 14, but illustrating the blade in the closed position.

FIGS. 16 through 19 are a series of semi-schematic and semi-cross sectional views illustrating the blade, torsion springs and bushings during a sequence events that occur as the blade is rotated from open to closed.

Figure 16:
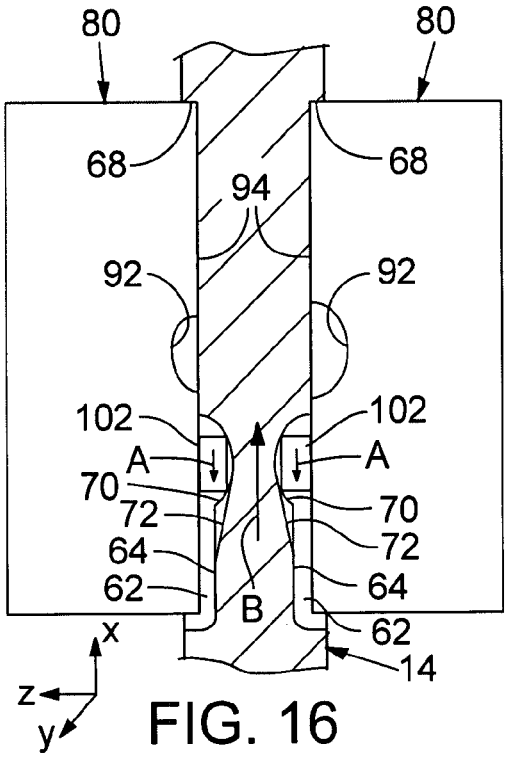

FIG. 16 illustrates the structural arrangement of the blade, torsion springs and bushings when the blade is in the open position. FIG. 16 roughly corresponds to FIG. 10.

Figure 17:
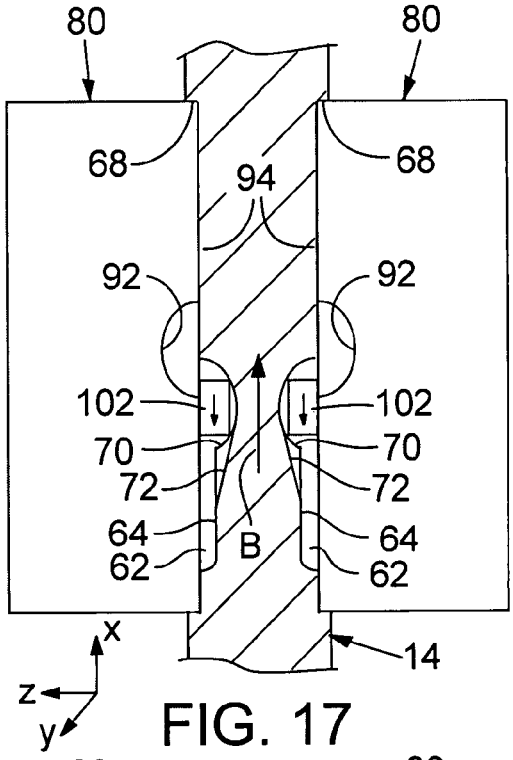

FIG. 17 illustrates the structural arrangement of the blade, torsion springs and bushings when the blade is rotated about 120° from the fully open position toward the closed position. FIG. 17 roughly corresponds to FIG. 11.

Figure 18:
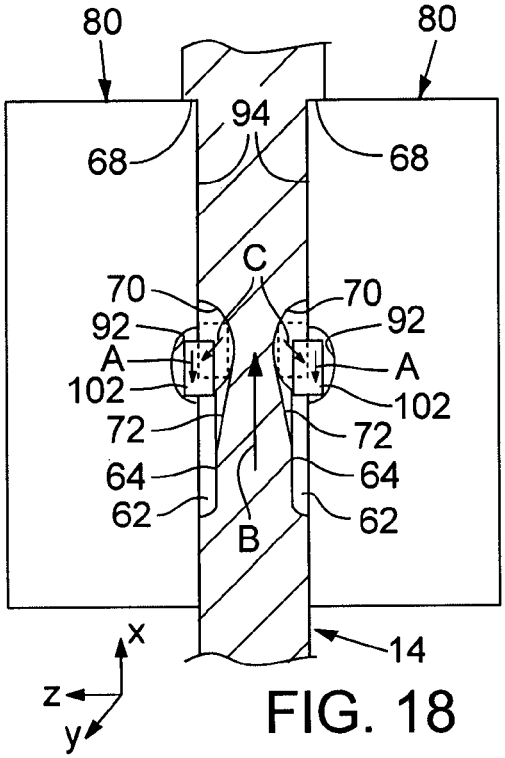

FIG. 18 illustrates the structural arrangement of the blade, torsion springs and bushings when the blade is 140° from the fully open position toward the closed position. FIG. 18 roughly corresponds to FIG. 12.

Figure 19:
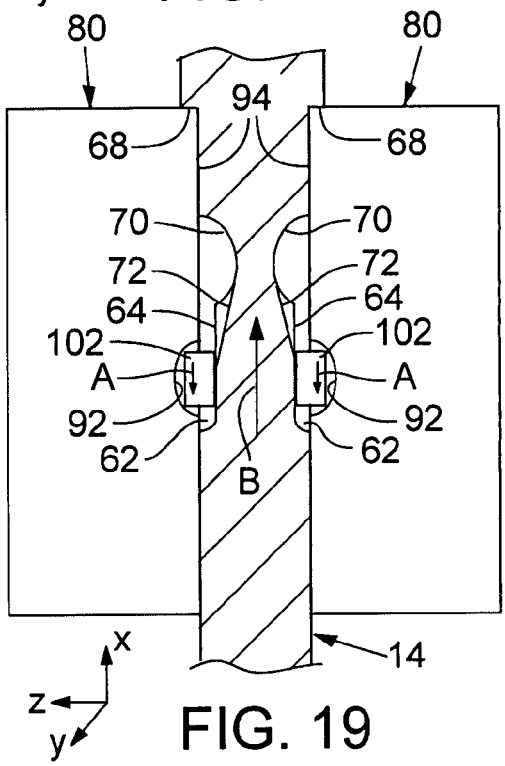

FIG. 19 illustrates the structural arrangement of the blade, torsion springs and bushings when the blade is in the closed position. FIG. 19 roughly corresponds to FIG. 13.

DETAILED DESCRIPTION OF THE PREFERRED EMBODIMENTS

Figure 2:
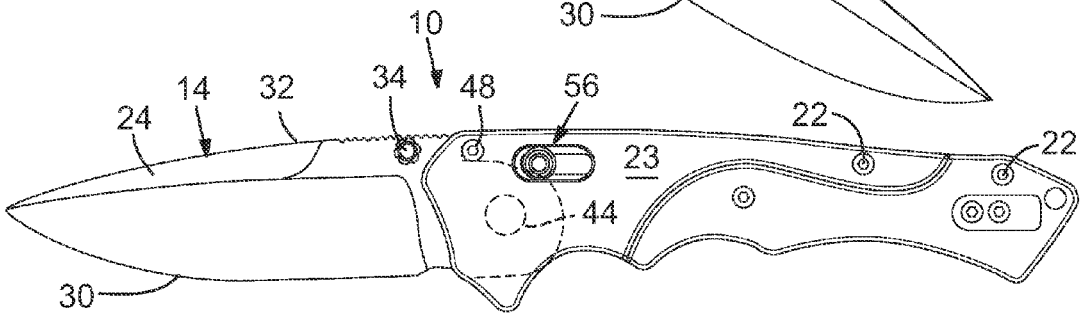
FIG. 2 is side elevation view of the knife illustrated in FIG. 1.
Figure 3:
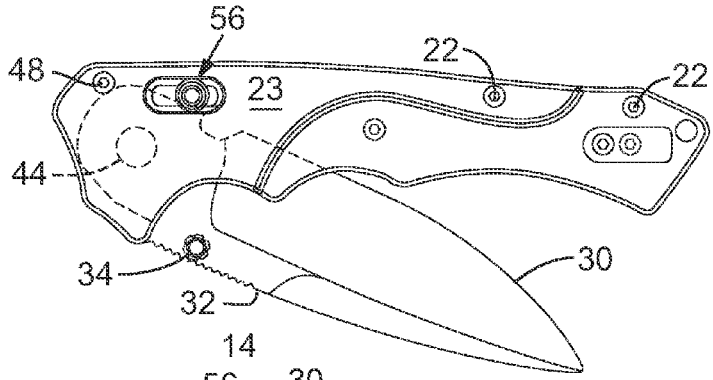
FIG. 3 is side elevation view similar to FIG. 2 with the blade shown midway between the open and closed positions.

A first illustrated embodiment of a folding knife 10 incorporating an opening assist mechanism according to the present invention is illustrated in FIGS. 1 through 19. Folding knife 10 includes an elongate handle 12, and a blade 14 that is pivotally attached to the handle at one of its ends—referred to herein as the "forward" end of the handle. Other relative directional terms correspond to this convention: the "rear" or butt end of the handle is opposite the forward end; the "upper" part of the blade is the dull, non-working portion and the "lower" part of the blade is the sharpened, working portion; "inner" or "inward" refers to the structural center of the knife, and so on. FIGS. 1 and 2 show the knife 10 with the blade 14 in the open position. FIG. 3 illustrates the blade midway in its rotation from the open to the closed position, and in FIG. 4 the blade is shown in the closed position in which the blade, shown partly in dashed lines, is received in a blade-receiving groove defined within the handle 12 between the sidewalls. An X-Y-Z axis grid is shown in FIG. 1. The X-Y plane is defined as the plane parallel to the plane defined by the handle 12 and blade 14—the blade travels in the X-Y plane as it is rotated between the closed and open positions. The Z plane is the plane transverse to the X-Y—the blade pivot pin extends longitudinally in the Z-plane.

The blade 14 of the knife 10 of the present invention incorporates a blade locking mechanism so that blade may be locked securely in the open position to prevent the inadvertent movement of the blade to its closed position. The blade locking mechanism is described below.

Handle 12 of knife 10 comprises several components, including a pair of oppositely located side wall sections, generally indicated at 16, 18, that are parallel with each other and held spaced apart from one another by spacers 20, only one of which is shown in FIG. 1. Each of the side wall sections 16 and 18 comprise an inner liner and an outer plate that are held parallel to one another. Specifically, side wall 16 is defined by liner 17 and outer plate 19. Likewise, side wall 18 is defined by liner 21 and outer plate 23. The spacers 20 are cylindrical sleeves that have a threaded internal bore into which screws 22 are threaded. The screws thus secure the spacers between the liners 17 and 21 of side walls 16 and 18 to maintain the handle 12 in a secure relationship with side walls 16 and 18 held in a spaced apart relationship. Side wall sections 16 and 18 may be fabricated from any suitable material such as a reinforced synthetic plastic; other suitable materials include metal, other plastics, wood, etc. The side wall sections may be fabricated in singled or multiple pieces. As shown in FIG. 1, an optional pocket clip 25 may be included if desired—the clip is attached to the exterior surface of side wall 16.

The blade 14 is pivotally attached to the handle 12 near the forward end of the handle. The blade used with knife 10 may be of any known type. The blade 14 shown in the drawings comprises an elongate working portion shown generally at 24 and a tang portion, shown generally at 26. The blade 14 is pivotally attached the handle 12 with a blade axis pin (detailed below). Working portion 24 typically includes a sharp edge 30 and a blunt edge 32. A thumb lug 34 may be included on blade 14 to assist with opening and closing the blade.

Figure 4:
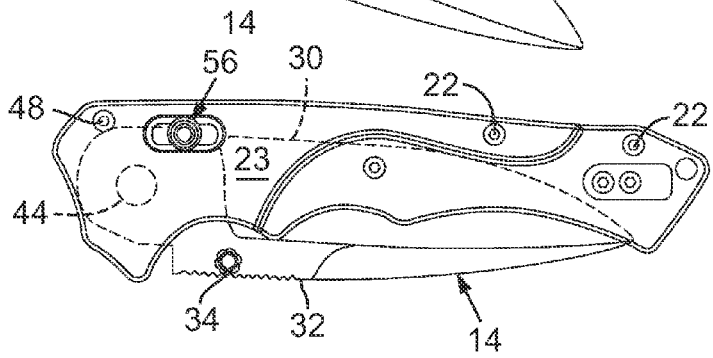
FIG. 4 is side elevation view of the knife illustrated in FIG. 3 showing the blade in the fully closed position.

A blade receiving groove 36 is defined between the side walls16, 18 by virtue of the spacers 22, described above. The blade receiving groove 36 defines a slot into which the blade 14 is received when it is moved to its closed position, as shown in FIG. 4. When the blade is in the closed position, the sharp edge 30 of the blade is held safely within the confines of the handle.

Figure 5:
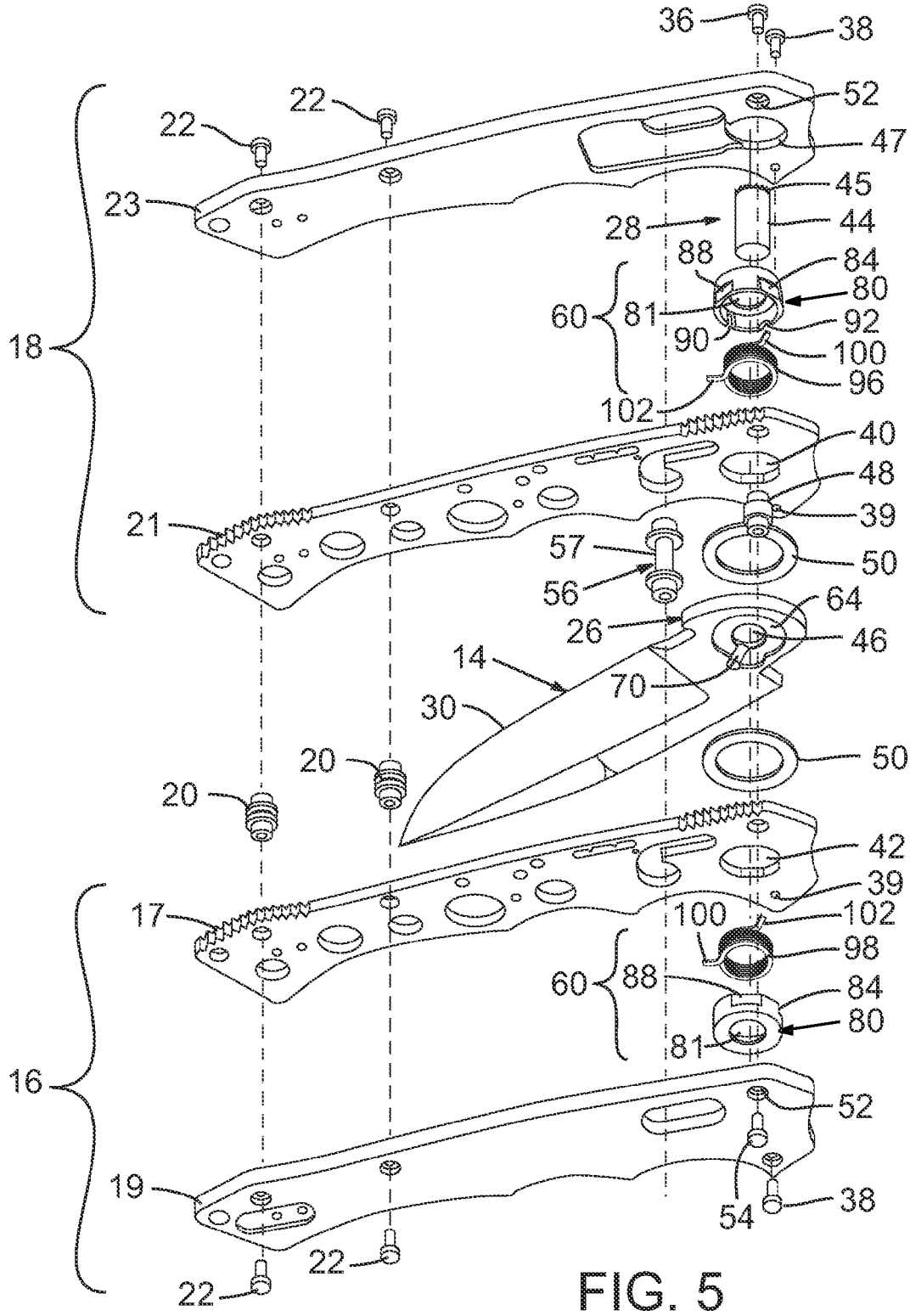
FIG. 5 is an exploded, perspective view of the knife of FIG. 1, illustrating selected component parts.

Blade 14 is attached to handle 12 such that the blade's working portion 24 extends away from the handle 12 when the blade 14 is in its open position (FIG. 1), and tang portion 26 is located within the blade receiving groove 36 between the paired handle side walls when the blade is in either the open or the closed position. That is, the tang portion 26 is always located between the side walls 16 and 18 of handle 12. The blade is pivotally attached to the handle with blade axis pin, which extends transverse to the plane of the blade and defines a blade pivot shaft. Turning briefly to FIG. 5, blade axis pin 28 is defined by a cylindrical sleeve 44 that extends through a bore 40 formed in liner 21, and an aligned bore 42 formed in the liner 17. The sleeve also extends through aligned pivot bore 46 through tang portion 26 of blade 14. In the assembled knife 10, cylindrical sleeve 44 is fitted snugly and fixedly through the pivot bore 46 in tang 26 of blade 14 so that the sleeve defines a rotational pivot axis for the blade extending transversely with respect to the plane of the blade and the side walls. Thus, sleeve 44 is axially aligned in the Z-direction—transverse to the X-Y plane. With continuing reference to FIG. 5, one of the ends of sleeve 44 has a lip 45, the outer circumference of which is knurled. The opposite ends of the sleeve 44 are received in circular counter bored recesses 47 in the respective handles, only one of which is shown in the view of FIG. 5. Washers 50 lie between the blade 14 and the liners 17 and 21 such that the sleeve 44 extends through the washers.

A blade stop pin 48 has its opposite ends anchored in counter bored holes 52 formed in outer plates 19 and 23 and held in place with screws 36 and 54. Screw 38 shown in FIG. 5 threads into a threaded opening 39 in liner 17—an identical screw 38 threads into a threaded opening 39 in liner 21.

When the knife 10 is assembled with the various screws and spacers described above and shown in the drawings, the opposite ends of the cylindrical sleeve 44 are securely captured in the counter bored recesses 47 and the knife is very stable.

As noted previously, knife 10 incorporates a locking mechanism for locking the blade in the open position. With reference to FIG. 5, the locking mechanism is shown generally with reference number 56 is fully described in U.S. Pat. No. 6,574,869, which is assigned to the assignee of the present invention, and the disclosure of which is incorporated herein by this reference. More specifically, the locking mechanism 56 used in knife 10 of the present invention is the same as the locking mechanism described in FIGS. 14 through 17 of U.S. Pat. No. 6,574,869 and described in the specification of that patent. It will be appreciated that because the locking mechanism 56 does not form a part of the present invention, not all of the component parts of the locking mechanism are shown or identified with reference numbers in the attached drawings. Nonetheless, blade locking pin 57 is identified; it is a spring-loaded pin that extends through the knife handle with its opposite ends extending through slots in the handles. The pin 57 locks the blade in the open position by virtue of its contact with a specialized surface of the tang 26. It will further be appreciated that there are many different kinds of locking mechanisms that will work well in connection with the opening assist mechanism described herein, including for example liner locks and lock back mechanisms.

Figure 9:
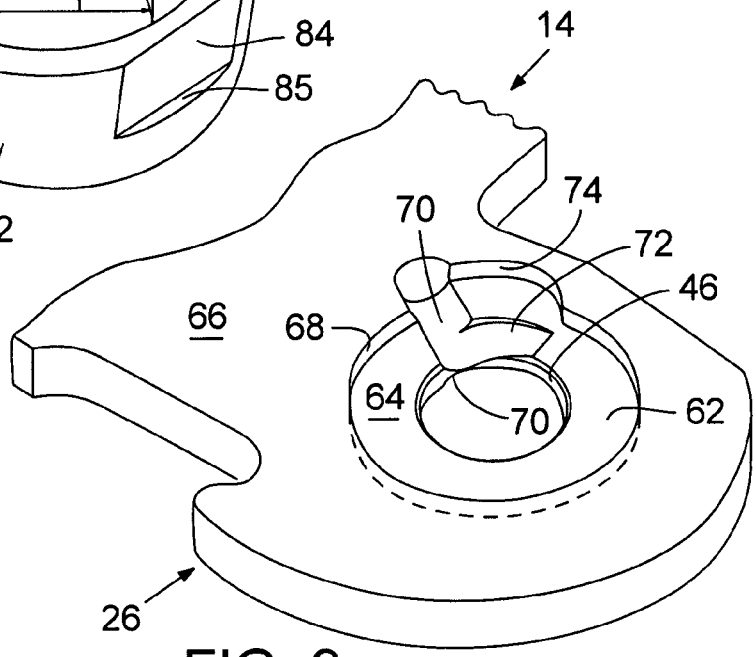
FIG. 9 is a perspective view of the tang portion of the blade, illustrating the blade pocket in which a torsion spring resides.

With reference to FIG. 5, knife 10 incorporates an opening assist mechanism 60 that comprises several components. The mechanism 60 will be described generally initially with reference to several drawing figures, and its structure and operation will then be detailed with reference to other drawings. As illustrated in FIG. 9, the tang portion 26 of blade 14 has a circular recess 62 formed annularly around the bore 46 through which blade axis pin 28 extends. The recess 62 defines an annular depression in the surface of the tang of the blade that may be formed by milling the blade, or during casting of the blade. Thus, the recess 62 has a base surface 64 that is recessed below the level of surface 66 of the remainder of the tang 26. A step 68 forms the outer peripheral edge of the base surface 64. A pocket or groove 70 is formed in recess 62 such that the groove 70 radiates outwardly from the central axis through bore 46. The groove 70 has curved walls. Stated another way, and as best illustrated in FIG. 9, the groove 70 defines a longitudinal section of a cylinder that has curved walls. As detailed below, because the walls of the groove 70 are angled, the spring leg that rides in the groove 70 at some times during rotation of the blade is able to transfer into and out of the groove 70. An angled or ramped section 72 extends from one side of the groove 70 at the edge of bore 46 and slopes upwardly a short radial distance until the ramped section meets the level of base surface 64. For the reasons detailed below, the ramped section 72 is optional. Finally, the circular recess 62 includes a scalloped out portion 74 extending from the outermost edge of groove 70 a short radial distance around the circular recess. The edge of the scalloped out portion 74 defines a portion of the circular recess 62 with a larger diameter.

Although only one side of blade 14 is shown in FIG. 9, it is to be understood that the opposite side of blade 14 includes a circular recess identical in structure to the one described herein, although as detailed below, the structures of the circular recess on the opposite side of the blade are axially rotated relative to the structures illustrated in FIG. 9.

Figure 8:
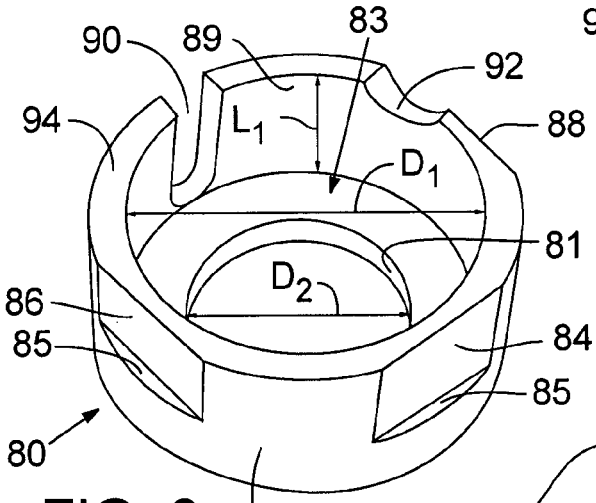
FIG. 8 is a perspective a view of one of the bushings.

The next structure that is a component of the opening assist mechanism 60 is illustrated in FIG. 8, and comprises a bushing 80. Bushing 80 is a generally cylindrical member 82 that has three flattened portions 84, 86 and 88 formed at intervals around the outer wall of the bushing. Each of the flattened portions extends partially along the cylindrical wall 89 of bushing 80, defining a stop 85 for each flattened portion. As detailed below, the bushing is inserted into a cooperatively shaped circular opening in the liner, which has three flattened portions that correspond to the three flattened portions 84, 86 and 88 on the bushing. The three flattened portions of the bushing cooperate with the flattened portions of the openings in the liners to fix the busing relative to the liner and thereby prevent the bushing from rotating relative to the liner. The "interior" of bushing 80 defines a first diameter D1 in FIG. 8, and the opening 81 at the end 83 of the bushing defines a second diameter D2 that is smaller than D1. The inner cylindrical wall 89 defines a height L1. Finally, there is a first notch 90 and a second notch 92 formed in the inner annular edge 94 of cylindrical wall 89. Second notch 92 is smaller than first notch 90. The diameter of the interior opening in the washers 50 is larger than the outer diameter of the bushings 80 so that when the knife is assembled, the bushings extend through the washers, as detailed below.

Figure 6:
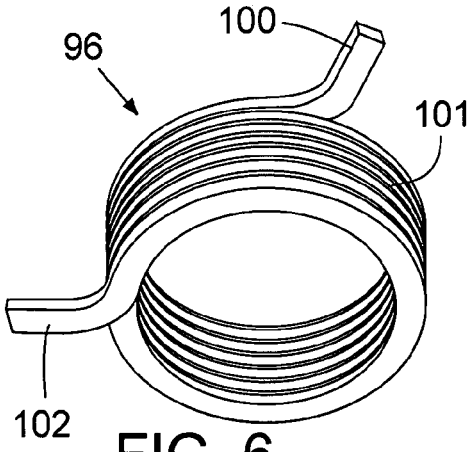
FIG. 6 is a perspective view of one of the torsion springs.
Figure 7:
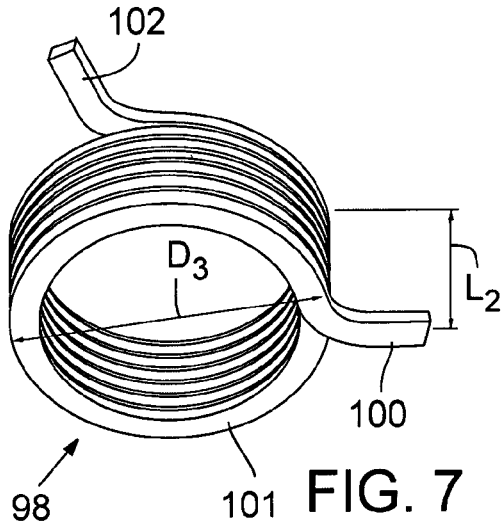
FIG. 7 is a perspective view of the opposite of the torsion springs.

Turning now to FIGS. 6 and 7, the two torsion springs 96 and 98 used in the opening assist mechanism 60 are illustrated. The springs 96 and 98 are mirror images of one another and have a body length L2 that is slightly less than height L1 of cylindrical wall 89 of bushing 80, and a diameter D3, which is slightly less than diameter D1 of bushing 80. Spring 96 is a left hand spring and spring 98 is a right hand spring. It will be appreciated that there are many different kinds of torsion springs that will suffice for use in the present invention. The torsion springs 96 and 98 illustrated herein are flattened wire type springs that having coiled body portions 101 and straight legs 100 and 102, which define spring ends.

The assembly of opening assist mechanism will be described with reference to one bushing and one torsion spring. However, as appreciated from the description herein and the drawings of the illustrated embodiment, the opening assist mechanism relies upon a bushing and torsion spring on each side of the blade. Nonetheless, an opening assist mechanism may be built based on the present disclosure that utilizes only one torsion spring. In other words, the opening assist mechanism according to the present invention may be fabricated with only one spring on one lateral side of the blade. While a spring on both sides of the blade is the preferred embodiment, a single spring mechanism is suitable.

With returning reference to FIG. 5, knife 10 is assembled with torsion springs 96 and 98 received in the circular recesses 62 on opposite sides of blade 16 such that the innermost legs 102 of the springs are received in the recesses 62. The outermost leg 100 of each torsion spring rests in notch 90 in bushing 80. Bushing 80 is inserted through bore 42 in the liner 17 with the flattened portions 84, 86 and 88 aligning with corresponding flattened portions formed in the bore 42. The bushing may be inserted through bore 42 until the stops 85 abut the outer wall of the liner. As noted above, the flattened portions of the bushing 80 cooperated with the flattened portions of the bore 42 through liner 17 to fix the bushing relative to the liner. In other words, bushing 80 cannot rotate. Spring 98 is captured within the interior of bushing 80, and is retained in the bushing because the diameter D2 of bushing 80 is less than the diameter D3 of the springs. The spring 96 and bushing 80 on the opposite lateral side of blade 14 are assembled with liner 21 in the identical manner. "Outer" leg 100 of spring 96 is captured in notch 90 in the bushing. Because the bushing cannot rotate and leg 100 of the spring is captured in notch 90, one leg of each spring is fixed relative to the handle 12. Cylindrical sleeve 44 is inserted through the bushings, the springs, and the blade, and the opposite ends of the sleeve are retained in counter bored portions 47 in the respective outer plates 19 and 23 of handle sidewalls 16 and 18, respectively. The knurled outer lip on one end of sleeve 44 prevents rotation of the sleeve relative to the handle. It will be appreciated that because sleeve 44 is inserted axially through the center of the springs, the sleeve acts as a supporting arbor for the springs.

As indicated earlier, the body length L2 of spring 96 is slightly less than the height L1 of bushing 80. With the knife fully assembled and the handle halves screwed together, bushing 80, which as noted above is stationary with respect to handle 12, holds the innermost legs 102 of springs 96 and 98 in grooves 70 on both sides of the blade. The inner annular edge 94 of bushing 80 lies closely adjacent to the surface 64.

With returning reference to FIG. 9, when the knife 10 is assembled leg 102 of spring 96 resides in groove 70, at least at some times during rotation of the blade from closed to open, and from open to closed, as detailed below. The length of leg 102 is greater than the length of ramped section 72 of circular recess 62 (as show, for instance, in FIG. 10). Thus, when spring 96 is assembled with the other associated components, the end of leg 102 extends in groove 70 past the point where ramped section 72 ends. When spring 96 is under rotational torsion—i.e., when the spring is "loaded"—in the X-Y plane, the angular surface of groove 70 creates a force vector in the Z plane—i.e., transverse to the plane of the blade—that urges the leg 102 of spring 96 outwardly, away from the groove in circular recess 62, away from the longitudinally centerline through the blade. In other words, because at all times the surface of groove 70 that leg 102 is being forced against is angled, there is a force in the Z-plane that urges the leg out of the groove toward the bushing 80. Ramped portion 72 provides mechanical relief that allows the spring leg 102 to sit completely down into groove 70. As noted above and as shown in the drawings, the springs 96 and 98 are flat wire type springs. The relative geometric configurations between the spring leg and the sides of the groove 70 are important so that the spring leg will move into and out of the groove. It will be appreciated that the relative geometries described herein may be modified with the same functional characteristics being achieved.

The stationary bushing 80 holds the leg 102 in the groove 70, but as the blade rotates and winds the springs—i.e., loads the springs, the legs 102 slide along the inner annular edges 94 of bushings 80 until the inner portion of the legs begin to ride up the angled sides of the grooves 70. As the rotation continues and the legs 102 rotate toward notches 92 there is a force vector applied to legs 102 in the direction of the Z-plane by the angular edges of grooves 70. When the legs 102 align with notches 92 in bushings 80, the legs are forced very quickly into the notches. When the legs 102 are transferred into the notches 92, the rotational force of the springs is instantly removed from the blade and is transferred to the bushings, which as described above is stationary.

Operation of the opening assist mechanism 60 will now be described in detail beginning with the blade 14 in the closed position (e.g., FIGS. 4, 13 and 15). When in the blade 14 is in the closed position there is no pressure applied to the blade by the opening assist mechanism 60. When the blade is in the closed position, the springs 96 and 98 are torsionally wound and loaded, but their rotational force is applied through legs 102 to the stationary bushings 80. Accordingly, no force is applied to the blade by the opening assist mechanism 60 and the blade is retained in the closed position by virtue of the force applied to the tang of the blade by the locking mechanism 56. This feature of the locking mechanism 56 is fully described in U.S. Pat. No. 6,574,869. The force applied to blade 14 by pin 57 is sufficient to retain the blade in the closed position, and the blade will not open even when, for example, the knife is dropped, or subjected to a strong "flick of the wrist" type of motion. Nonetheless, it may be beneficial to include a "safety" mechanism that prevents the blade from opening when the blade is in the closed position.

As stated previously, the diameter of the interior opening in the washer is larger than the outer diameter of the bushings 80. As best seen in FIG. 14, this results in the bushings 80 extending through the washers in the assembled knife.

It will be appreciated from the foregoing description, from the drawings, and from the more detailed description that follows, that the bushing 80 as described may be replaced by any number of equivalent structures. As one example, the functional and structural characteristics of the bushing and the way that it interfaces with the torsion spring may be reproduced with a "bushing" that is an integral part of the liner or handle, as opposed to a separate piece. As another example, the handle may be fabricated in a single piece and the bushing may be a part of the unitary handle half.

The drawings of FIGS. 10 through 13 illustrate a sequence that occurs when the blade 14 is moved from the closed position (FIG. 13) to the open position (FIG. 10). Typically, the blade is rotated by the user applying pressure to thumb lug 34. As blade 14 is rotated, the circular recesses 62, which are structural features of the tang 26, rotate. This causes the structures associated with circular recess 62 to be rotated relative to the fixed busing 80. This relative rotation between the blade, the bushing, and the spring that is retained in the bushing with one leg fixed thereto results in the functional operation of the opening assist mechanism.

Beginning with FIG. 13, as described earlier, the blade 14 is shown retained in this closed position by virtue of the forward pressure of pin 57 of locking mechanism 56. Thus, pin 57 is under spring tension that urges the pin in the forward direction illustrated by arrow A. At all times, leg 100 of spring 98 is captured and led stationary in notch 90 of bushing 80, and bushing 80 is held stationary by virtue of the flattened portions on the bushing mating with the flattened portions of the bore in the liner 21 through which the bushing extends. In FIG. 13, spring 98 is wound and thus has significant potential energy. However, leg 102 is in notch 92 and the potential energy of the spring is thus bearing against the stationary bushing 80 and does not apply any rotational pressure to the blade 14 (i.e., in the X-Y plane), although there is force applied to the blade in the Z-plane direction by virtue of the curved edge of notch 92.

Turning to the next illustration in the sequence, FIG. 12, the blade has begun its rotation toward the open position (arrow B). Here, the leg 102 of spring 98 remains in notch 92. As a result, the potential energy of the spring has not been released and is still exerted against bushing 80. Simultaneously, the pin 57 has been urged rearwardly, toward the butt end of the handle 12, as the pin rides over the surface of the tang of the blade. Because the sides of notch 92 are curved, the leg 102 is at all times bearing on a curved surface. This is the same mechanical characteristic as described above with respect to leg 102 riding in groove 70. As a result, because the spring is applying significant pressure against the side of the notch, there is a force in the Z-plane direction that urges the leg in the direction toward the tang of the blade—i.e., out of notch 92. This applies some pressure between the leg 102 and the blade in the Z-plane, but this is not rotational pressure that would drive the blade open.

In FIG. 11, the blade has rotated in the counterclockwise direction in the drawing so that leg 102 is just on the threshold of being forced out of notch 92 in bushing 80. When leg 102 is forced out of notch 92 the leg immediately moves into and engages groove 70. Since the spring is wound and loaded, movement of the spring leg into groove 70 results in the immediate transfer of the potential energy from the stationary bushing 80 to the rotatable blade 14. The spring thus instantly applies its force as the spring uncoils to the blade to urge the blade rapidly to the open position.

In FIG. 10 the blade is shown in the open and locked position. In this position an edge on the tang of the blade abuts stop pin 48, which stops the rotation of the blade. The blade is locked by virtue of pin 57 extending transversely across the upper edge of the tang and being wedged between handle side walls and the blade. It may be seen in FIG. 10 that the leg 102 is resting in groove 70, having rotated in the counterclockwise direction in the drawing away from notch 92. Ideally, in this position, spring 98 still exerts pressure on the blade in order to maintain this position.

Attention is now directed to FIG. 14, which illustrates knife 10 with blade 14 in the open position, and which is a close up cross sectional view taken through the portion of the handle and blade where the blade attaches to the handle. With blade 14 in the open position, legs 102 of torsion springs 96 and 98 are resting in grooves 70 of the circular recesses 62 formed in both sides of tang 26. The springs are maintained within the grooves 70 by the inner annular edge 94 of bushing 80. The springs 96 and 98 are still slightly wound, or loaded, in this position, so they continue to exert some pressure on the blade and thereby force the blade against the stop pin 48. The fixed legs 100 of both springs are seen captured in notches 90 of bushing 80, and notches 92 are of course not occupied. Because the springs continue to apply pressure to the blade when the blade is in the open position, the lock mechanism is assured of positive locking. This may be contrasted with many opening assist mechanisms, which drive the blade to open but do not apply pressure to the blade after a certain point in the blade's rotation. This results in the possibility of failure to lock.

FIG. 15 is similar to FIG. 14 except it shows knife 10 with blade 14 in the closed position. Here, the springs 96 and 98 are fully wound and thus fully loaded with potential energy. However, in this position the legs 102 have been forced out of contact with blade 14 and thus reside in notches 92 where they apply their potential energy against the stationary bushing 80.

It will be appreciated that when the blade is in the open position the locking mechanism may be unlocked and the blade may be rotated to the closed position. The sequence of events that occur as the blade moves from open to closed is shown by the series of drawings of FIG. 10 through FIG. 13. Beginning with FIG. 10, the blade is unlocked by moving the pin of locking mechanism 56 rearwardly toward the butt end of the knife so that the pin disengages from the tang of the blade. The blade is then rotated in the clockwise direction in FIG. 10 (i.e., opposite the direction of arrow B). As this happens, the leg 102 is pushed by the edge of groove 70, thereby winding spring 98.

As rotation of the blade continues in the clockwise direction, the spring continues to be wound, or loaded, imparting greater potential energy to the spring. In FIG. 11 the leg 102 is still in groove 70, but the position of the leg 102 is approaching the point where the leg aligns with notch 92. In FIG. 12 the leg 102 has aligned with notch 92 and the leg 102 is forced from groove 70 into notch 92, thereby transferring the spring pressure from the blade to the bushing. The primary structure causing leg 102 to be forced from the groove 70 into notch 92 is the sloped sides of the groove 70, which tend to "lift" the leg in the Z-plane, toward notch 92. The ramped portion 72 contributes additional "lifting" action that forces the leg in the Z-plane and into notch 92, but as noted above, the primary function of ramped portion 72 is to allow leg 102 to rest completely in the groove 70.

In FIG. 13 leg 102 may be seen in notch 92. As a result, the blade rotates freely into the closed position. And as noted above, the spring pressure applied to locking mechanism 56 urges the pin of the mechanism forward, retaining the blade in the closed position.

Attention is now directed to the series of drawings of FIGS. 16 through 19, which comprise a sequential series of semi-schematic illustrations showing the structure and functional attributes of the opening assist mechanism. In this series of drawings the only components that are shown are the bushings 80, the legs 102 of springs 96 and 98, and a small portion of blade 14. These drawings are semi-schematic because they omit for clarity certain structures that would normally be seen in these views. Moreover, as noted above, the structures in the circular recesses 62 on each side of the blade are axially rotated relative to one another. In other words, groove 70 on one side of the blade is not in the same position as groove 70 on the opposite side of the blade. The primary reason for this relative rotation of the structures is to maintain the strength and integrity of the blade. But as such, not all of the structures shown in FIGS. 16 through 19 would actually be seen if these cross sectional views were structurally accurate. However, they are presented here in the manner shown in order to facilitate a detailed explanation of the invention and how it operates.

Beginning with FIG. 16, blade 14 is in the open position. Legs 102 of both torsion springs (96 and 98) are retained in grooves 70 because the inner annular edges 94 of the bushings 80 are held closely abutting the surface of the tang 26 of the blade. The springs are slightly-loaded, and the direction of the force that the springs apply to the blade is shown with arrows A. Arrow B represents the vector direction in which force is applied to blade 14 to move it from the open position toward the closed position. In this blade-open position, notches 92 are unoccupied.

In FIG. 17 the blade has begun its rotation from the open position toward the closed position. As this occurs, the springs 96 and 98 are being wound—loaded. That is, as the blade is rotated (represented by arrow B—which corresponds to clockwise rotation of the blade in the view of FIGS. 10 through 13), the legs 102 are carried and pushed by the grooves 70 to wind the springs. Notches 92 are still unoccupied, but the position of the notches is approaching the position of the legs 102.

In the next sequential drawing of FIG. 18, as rotation of blade 14 continues in the direction represented by arrow B, notches 92 have now rotated to the point where the notches begin to align with the legs 102 of the springs, and the legs 102 are simultaneously being "lifted" in the direction of the Z-axis by the curved sides of grooves 70—represented by arrows C. Once the legs 102 are able to be received in notches 92 they are pushed into the notches by the curved sides of grooves 70 and the spring force (arrows A) is immediately transferred from the blade 14 to the bushing 80. The blade is at this point under no spring force applied by the opening assist mechanism and is thus freely rotatable to the closed position. When a locking mechanism such as that described above is used with the knife, the transverse pin 57 at this point urges the blade to continue toward the closed position.

In the final drawing of this sequence, FIG. 19, the blade 14 is in the closed position and there is no spring force being applied to the blade by the springs 96 and 98. As noted above, springs 96 and 98 are under considerable potential energy, but that energy (arrows A) is being directed only to bushing 80. The legs 102 are in this position resting in the scalloped out portions 74 of the circular recesses 62.

From the foregoing description it will be appreciated that the opening assist mechanism described with reference to FIGS. 1 through 19 may be applied to a multitude of other equivalent mechanical constructs. As noted above, it will be appreciated that bushing 80 may be eliminated and replaced by any structure and method for connecting the torsion spring to the liner or handle. Bushing 80 may in this sense be seen as an optional structure that could be replaced by any equivalent structure for performing the function. There are many structural equivalents that can perform the function. As one example, the structure defined by the bushing could be formed as an integral part of the liner or handle rather than as a separate structure as described above in the preferred embodiment. Further, the bushing could be replaced by a recess formed in the liner that serves to contain the spring, fix one spring leg, and defines a notch into which the other spring leg may reside to remove spring pressure from the blade and transfer the spring pressure to the liner. With this as context, the word "bushing" as used herein is not limited to a structure that is separate from the liner or handle, but instead should be read to encompass any structure that facilitates the function ascribed to the bushing herein.

While the present invention has been described in terms of a preferred embodiment, it will be appreciated by one of ordinary skill that the spirit and scope of the invention is not limited to those embodiments, but extend to the various modifications and equivalents as defined in the appended claims.

I claim:

1. A folding knife, comprising, a handle having first and second handle halves held in a spaced apart relationship to define a blade groove therebetween;

a blade pivotally connected between the handle halves with a pivot shaft extending through a bore in a tang portion of the blade so that the blade is movable in a rotational path between an open position and closed position, said blade having a first side and a second side and a first annular recess around the bore on the first side of said blade and a first radial groove extending away from the bore;

a first bushing fixed to said first handle half and the bushing having an inner edge to the annular recess;

a first torsion spring around the pivot shaft, said first torsion spring having a first leg fixed relative to the handle and a second leg in the first radial groove during only a portion of the rotational path.

2. The folding knife according to claim 1 in which the blade pivots in a first plane and the second leg is configured for movement in a first direction that is in a plane parallel to the first plane.

3. The folding knife according to claim 2 in which the second leg is configured for movement in a second direction that is substantially transverse to the first plane.

4. The folding knife according to claim 1 wherein rotation of the blade from the open position to the closed position causes the spring to wind.

5. The folding knife according to claim 1 wherein said blade has a second annular recess around the bore on the second side of said blade, the second annular recess having a second radial groove extending away from the bore, and a second bushing on the second side of the blade, said second bushing having an inner edge received in the second annular recess, and a second torsion spring and around the pivot shaft, the second torsion spring having a first leg fixed to the bushing and a second leg in the second radial groove during only a portion of the rotational path.

6. The folding knife according to claim 5 wherein the inner edge of each bushing includes a notch in which the second leg of the springs reside when the blade is in a predetermined rotational position.

7. The folding knife according to claim 5 wherein the inner edge of the bushing includes a notch in which the second leg of the spring resides when the blade is in a predetermined rotational position.

8. The folding knife according to claim 7 wherein when the blade is in the closed position the second leg of the spring is in the notch and the spring is wound and all spring force is applied to the bushing.

9. The folding knife according to claim 8 wherein when the blade is rotated a predetermined distance from the closed toward the open position the second leg moves out of the notch and applies spring force to the blade to cause the blade to move to the open position.

10. The folding knife according to claim 5 wherein the first handle half includes a first liner and the second handle half includes a second liner, wherein the first bushing extends through a bore in the first liner and the second bushing extends through a bore in the second liner.

11. A folding tool having a handle with opposed first and second side walls, each side wall defined by an inner liner and an outer plate, said side walls held in a spaced apart relationship with a slot therebetween, and a blade pivotally connected to the handle between the side walls with a pivot shaft extending through a bore in the blade so the blade is movable about the pivot shaft between a closed position and an open position, comprising:

a first annular recess formed in a first side of the blade around the bore and a first radial groove extending away from the bore, said first radial groove defining curved walls;

a second annular recess formed in a second side of the blade around the bore and a second radial groove extending away from the bore, said second radial groove defining curved walls;

a first spring retainer immovable relative to the first side wall, said first spring retainer having an edge in the first annular recess;

a second spring retainer immovable relative to the second side wall, said second spring retainer having an edge in the second annular recess;

a first torsion spring in the first spring retainer, said first torsion spring having a first leg fixed to the first spring retainer and a second leg in the radial groove when the blade is in the open position; and a second torsion spring in the second spring retainer, said second torsion spring having a first leg fixed to the second spring retainer and a second leg in the radial groove when the blade is in the open position.

12. The folding tool according to claim 11 wherein each spring retainer further comprises a body having an annular edge received in the annular recesses, and wherein the annular edge of each spring retainer includes a notch in which the second leg of the spring resides when the blade is in a predetermined rotational position.

13. The folding tool according to claim 12 wherein when the second leg of a spring is residing in the notch, the spring exerts force on the body of the spring retainer.

14. The folding tool according to claim 13 wherein when the blade is in the closed position the second leg of the spring is in the notch and the spring is wound and all spring force is applied to the bushing.

15. The folding tool according to claim 14 wherein the handle defines a handle plane and when the blade is rotated a predetermined distance from the closed toward the open position the second leg moves in a direction transverse to the handle plane and applies spring force to the blade to cause the blade to move to the open position.

16. A folding knife, comprising, a handle having first and second handle halves held in a spaced apart relationship to define a blade groove therebetween;

a blade connected between the handle halves with a pivot shaft extending through a bore in a tang portion of the blade so that the blade is rotatable in a path between an open position and closed position, said blade having an annular recess around the bore and a radial groove extending away from the bore;

a torsion spring around the pivot shaft, said torsion spring having a first leg fixed relative to the handle and a second leg in the radial groove during only a portion of the rotational path and when the second leg is in the radial groove the spring exerts force against the blade to move it toward the open position and when the second leg is not in the radial groove the spring exerts no force against the blade.

17. The folding knife according to claim 16 including a means defined by a bushing fixed to the handle for transferring spring force to and from the blade when the blade is in a predetermined rotational position.

18. The folding knife according to claim 17 wherein the bushing has an inner edge in the annular recess and the first leg of the torsion spring is fixed to the bushing.

* * * * *